United States Patent [19]

Curatola

[11] 4,216,957

[45] Aug. 12, 1980

[54] STRIKING BAG EXERCISE STRUCTURE

[76] Inventor: Edward R. Curatola, 295 Jewett Ave., Staten Island, N.Y. 10302

[21] Appl. No.: 924,737

[22] Filed: Jul. 14, 1978

[51] Int. Cl.[3] ..... A63B 69/00

[52] U.S. Cl. ..... 272/78; 248/161

[58] Field of Search ..... 272/85, 86, 87, 88, 272/89, 90, 91, 92, 76–78; 273/55 R, 55 A; 297/273, 274, 275, 276, 278; 248/161, 263

[56] References Cited

U.S. PATENT DOCUMENTS

| | | | |
|---|---|---|---|
| 237,820 | 2/1881 | Clark | 272/88 |
| 818,604 | 4/1906 | Bierd | 272/78 |
| 1,050,501 | 1/1913 | Walter | 272/78 |
| 1,578,633 | 3/1926 | Bonde | 272/78 |
| 1,603,578 | 10/1926 | Biernat | 297/273 |
| 2,398,384 | 4/1946 | Meyers | 297/273 |
| 3,022,072 | 2/1962 | Zinnou | 272/78 |
| 3,304,089 | 2/1967 | Smith | 273/55 R |
| 3,510,131 | 5/1970 | Gardner | 272/78 |

FOREIGN PATENT DOCUMENTS

| | | | |
|---|---|---|---|
| 1264655 | 12/1961 | France | 272/85 |
| 266057 | 12/1928 | Italy | 297/273 |
| 8238 | of 1903 | United Kingdom | 272/90 |
| 23507 | of 1912 | United Kingdom | 272/78 |
| 182058 | 12/1921 | United Kingdom | 272/78 |

*Primary Examiner*—Richard C. Pinkham
*Assistant Examiner*—T. Brown
*Attorney, Agent, or Firm*—Daniel J. Tick

[57] ABSTRACT

First and second support structures are removably mounted on a cross bar at the first and second ends thereof, respectively. Each of the first and second support structures has first and second pipes each having spaced opposite first and second ends with a closed loop at the first end mounted coaxially around the cross bar. The second end of each of the first and second pipes is open. A strut having spaced opposite first and second ends is pivotally affixed at its first end to the first pipe at the second end of the first pipe and releasably coupled at its second end to the second pipe at the second end of the second pipe. Each of four legs is coaxially removably adjustably mounted in a corresponding one of the first and second pipes of the first and second support structures at the open ends thereof. A mounting device on the cross bar at the center thereof mounts a heavy punching bag or a speed punching bag.

2 Claims, 8 Drawing Figures

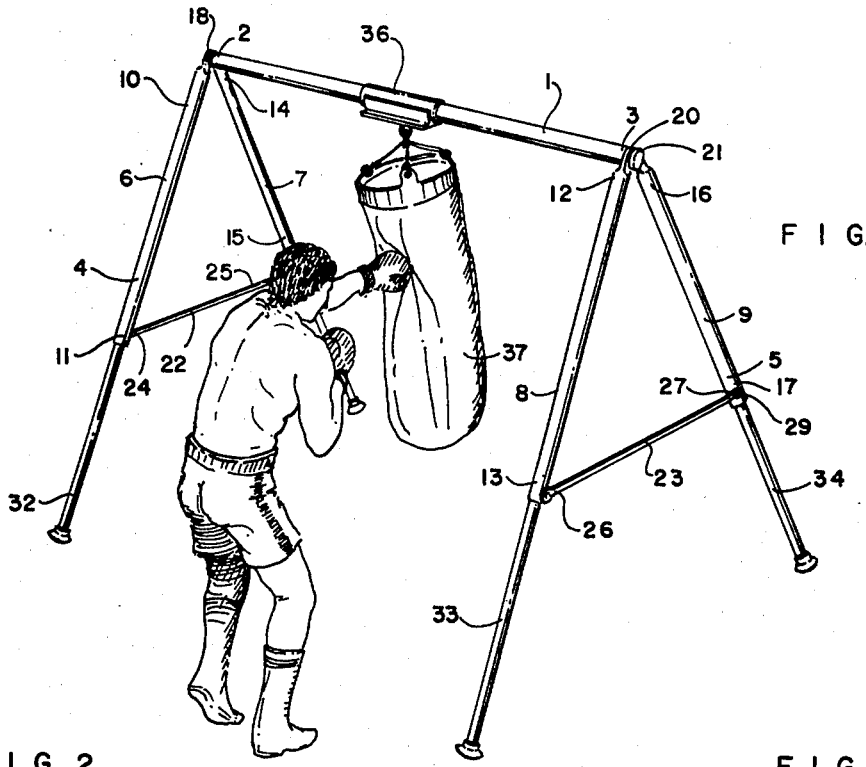
FIG. 1
FIG. 2
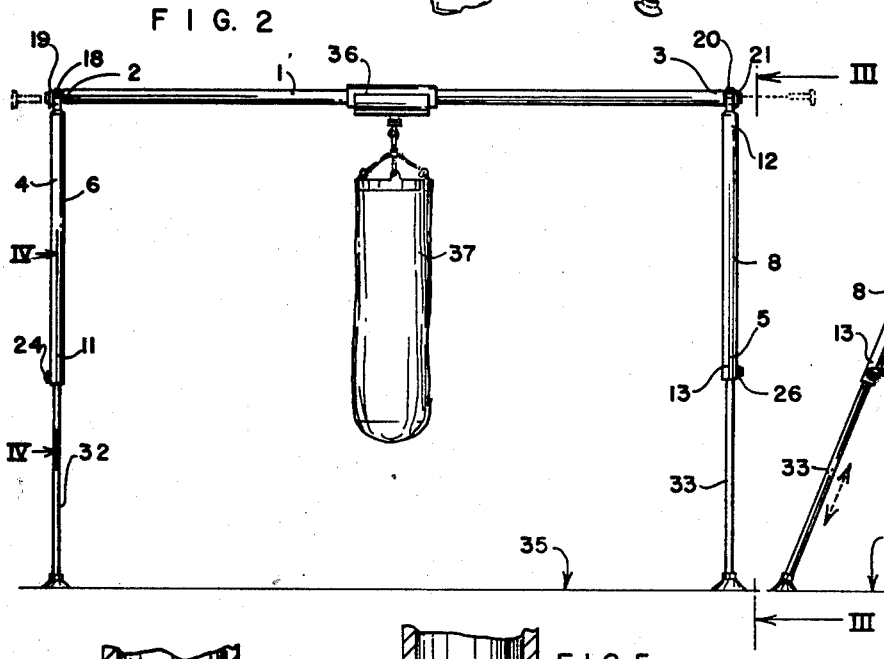
FIG. 3
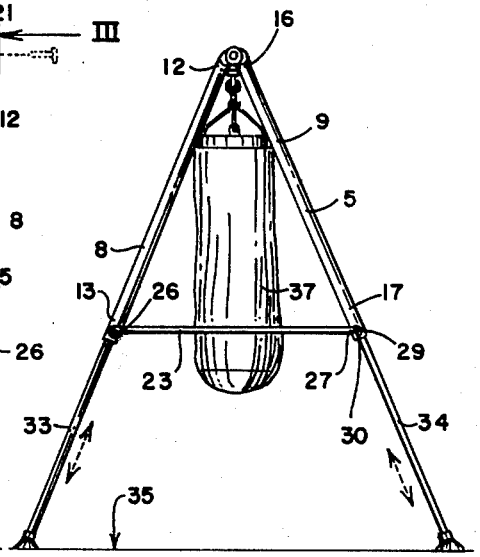
FIG. 4
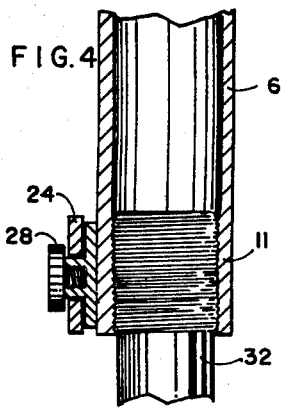
FIG. 5
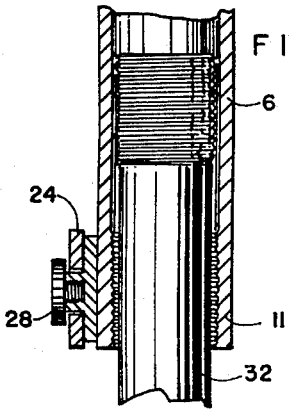

STRIKING BAG EXERCISE STRUCTURE

BACKGROUND OF THE INVENTION

The present invention relates to an exercise structure.

Exercise structures of the type disclosed herein are described in the following United States patents. U.S. Pat. No. 829,257, issued Aug. 21, 1906 to Cary, U.S. Pat. No. 1,032,139, issued July 9, 1912 to Hart, U.S. Pat. No. 1,578,633, issued Mar. 30, 1926 to Bonde, U.S. Pat. No. 3,030,109, issued Apr. 17, 1962 to Albitz, U.S. Pat. No. 3,399,891, issued Sept. 3, 1968 to McCormick et al and U.S. Pat. No. 3,510,131, issued May 5, 1970 to Gardner.

Objects of the invention are to provide an excercise structure of simple structure and very few parts, which is inexpensive in manufacture, sturdy and strong when assembled and disassembled with facility, convenience and rapidity, readily stores when disassembled, in a minimum space, and functions efficiently, effectively and reliably when assembled, as a support for a heavy punching bag or a speed punching bag, as desired, for excercise indoors or outdoors.

BRIEF DESCRIPTION OF THE DRAWINGS

In order that the invention may be readily carried into effect, it will now be described with reference to the accompanying drawings, wherein:

FIG. 1 is a perspective view of an embodiment of the exercise structure of the invention, mounting a heavy punching bag, and in use;

FIG. 2 is a front view of the embodiment of FIG. 1;

FIG. 3 is an end view, taken along the lines III—III, of FIG. 2;

FIG. 4 is a sectional view, on an enlarged scale, taken along the lines IV—IV, of FIG. 2, in the assembled condition of the exercise support structures;

FIG. 5 is the view of FIG. 4 in the disassembled condition of the support structures;

DETAILED DESCRIPTION OF THE INVENTION

Figure 6:
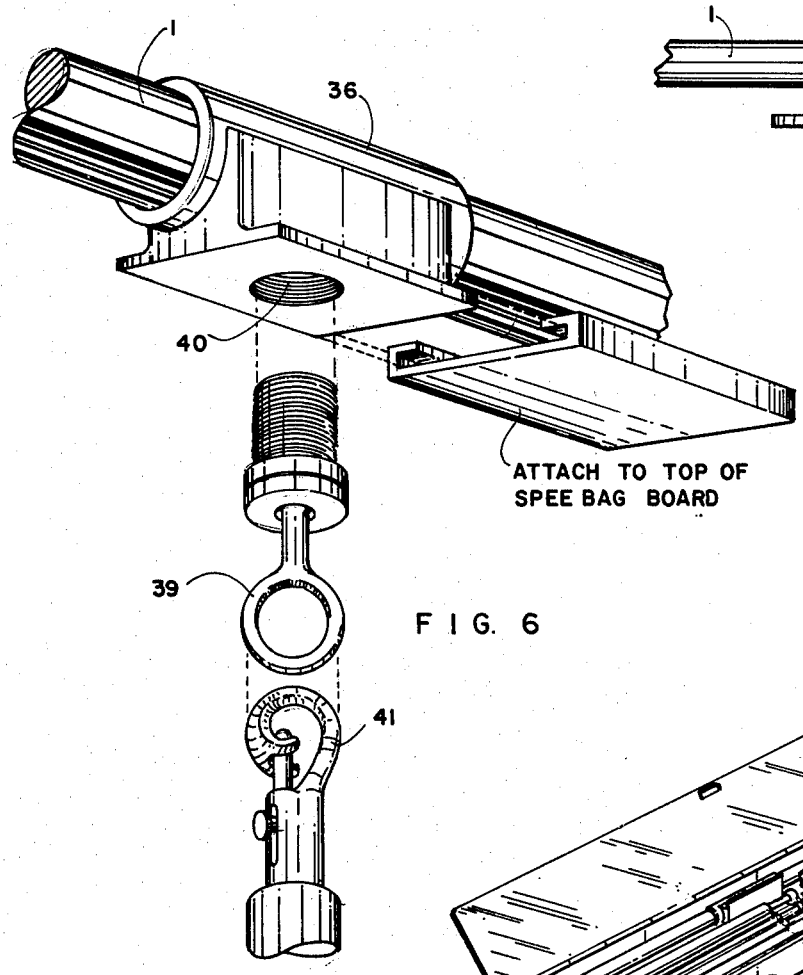
FIG. 6 is an exploded perspective view, on an enlarged scale, of an embodiment of a mounting device for mounting a speed punching bag on the cross bar of the exercise structure of the invention.

The exercise structure of the invention comprises a cross bar 1 (FIGS. 1, 2, 6 and 7) having spaced opposite first and second ends 2 and 3 (FIGS. 1 and 2).

First and second support structures 4 and 5, respectively, are removably mounted on the cross bar 1 at the first and second ends 2 and 3, respectively, of said cross bar. The first and second support structures 4 and 5 have first and second pipes 6 and 7, and 8 and 9, respectively, as shown in FIG. 1. The first pipes 6 and 8, respectively, have first and second ends 10 and 11, respectively, and 12 and 13, respectively. The second pipes 7 and 9, respectively, have first and second ends 14 and 15, and 16 and 17, respectively.

A closed loop 18 is provided at the first end 10 of the first pipe 6 (FIGS. 1 and 2). A closed loop 19 is provided at the first end 14 of the second pipe 7 (FIG. 2). A closed loop 20 is provided at the first end 12 of the pipe 8 (FIGS. 1 and 2). A closed loop 21 is provided at the first end 16 of the second pipe 9 (FIGS. 1 and 2). The closed loops 18, 19, 20 and 21 of the first and second pipes are coaxially mounted around the cross bar 1 when the exercise structure of the invention is in its assembled condition.

The first and second support structures 4 and 5, respectively, have struts 22 and 23, respectively. The strut 22 has spaced opposite first and second ends 24 and 25, respectively (FIG. 1). The strut 23 has spaced opposite first and second ends 26 and 27, respectively (FIGS. 1 and 3). The strut 22 is pivotally affixed at its first end 24 to the first pipe 6 at the second end 11 of said first pipe and is releasably coupled at its second end 25 to the second pipe 7 at the second end 15 of said second pipe. The releasable coupling is accomplished by forming a hook at the second end 25 of the strut 22 and providing a projecting pin (not shown in the FIGS.) at the second end 15 of the second pipe 7, which pin cooperates with said hook. The pivotally mounted first end 24 of the strut 22 is removable via a set screw 28 (FIG. 4). The strut 23 is pivotally affixed at its first end 26 to the first pipe 8 in the second end 13 of said first pipe and is releasably coupled at its second end 27 to the second pipe 9 at the second end 17 of said second pipe. The releasable coupling is accomplished by forming a hook 29 (FIGS. 1 and 3) at the second end 27 of the strut 23 and providing a projecting pin 30 (FIG. 3) at the second end 17 of the second pipe 9, which pin cooperates with said hook. The pivotally mounted first end 26 of the strut 23 is removable via a set screw in the same manner as shown in FIGS. 4 and 5.

A first leg 32 is coaxially removably adjustably mounted in the first pipe 6 of the first support structure at the open second end 11 of said first pipe (FIGS. 1, 2 and 4). A second leg (not shown in the views of the FIGS.) is coaxially removably adjustably mounted in the second pipe 7 of the first structure 4 at the open end 15 of said second pipe. A third leg 33 is coaxially removably adjustably mounted in the first pipe 8 of the second support structure 5 at the open second end 13 of said first pipe (FIGS. 1 to 3). A fourth leg 34 is coaxially removably adjustably mounted in the second pipe 9 of the second support structure 5 at the open second end 17 thereof (FIGS. 1 and 3).

Each of the first, second, third and fourth legs is threadedly coupled to the corresponding pipes of the support structures, as shown in FIGS. 4 and 5, so that the height of the cross bar 1 above a supporting surface 35 (FIGS. 2 and 3) is adjustable by varying the length of the coupling.

Figure 7:
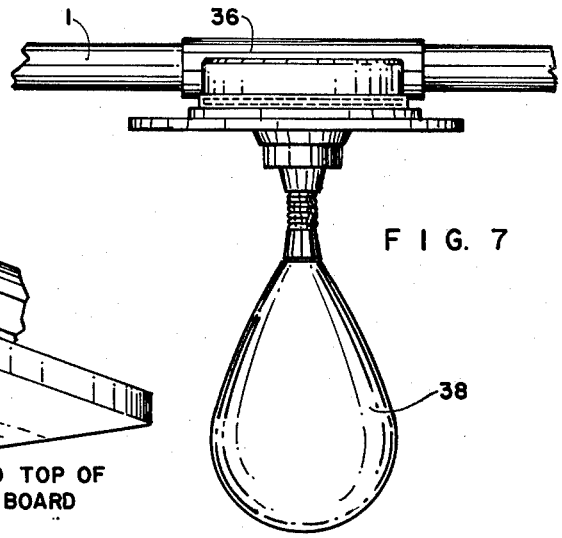
FIG. 7 is a view, on a reduced scale, of the embodiment of FIG. 6 in assembled condition.

A mounting device 36, shown in FIGS. 1 and 2, is provided on the cross bar 1 at substantially the center of said cross bar for mounting a heavy punching bag 37 (FIGS. 1 to 3). The mounting device 36 is adaptable, in the modification thereof shown in FIGS. 6 and 7, to mount a speed punching bag 38, as shown in FIG. 7. This is accomplished by an eye member 39 which is threadedly coupled into an internally threaded bore 40 of the mounting device 36. The speed punching bag 38 is coupled to the eye member 39 via a hook member 41.

Figure 8:
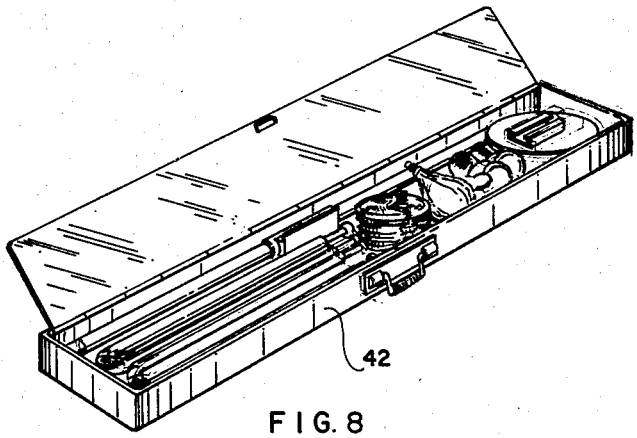
FIG. 8 is a perspective view of the exercise structure of the invention, disassembled and stored in a carrying case.

The exercise structure of the invention is readily stored and carried to a desired place in a storage box 42, as shown in FIG. 8, since the component parts of the exercise structure are of light weight metal or plastic, and the entire disassembled structure is easy to carry.

While the invention has been described by means of a specific example and in a specific embodiment, I do not wish to be limited thereto, for obvious modifications will occur to those skilled in the art without departing from the spirit and scope of the invention.

I claim:

1. An exercise structure, comprising a cross bar having spaced opposite first and second ends;

first and second support structures removably mounted on the cross bar at the first and second ends thereof, respectively, each of the first and second support structures having first and second pipes each having spaced opposite first and second ends with a closed loop at the first end mounted coaxially around the cross bar, the second end of each of the first and second pipes being open, and a strut having spaced opposite first and second ends and pivotally affixed at its first end to the first pipe at the second end of said first pipe and releasably coupled at its second end to the second pipe at the second end of said second pipe;

four legs each coaxially removably adjustably mounted in a corresponding one of the first and second pipes of the first and second support structures at the open second end thereof; and mounting means on the cross bar at substantially the center of said cross bar for mounting one of a heavy punching bag and a speed punching bag, said mounting means having a base plate mounted on said cross bar, said base plate having an internally threaded bore formed therein, and an eye member having a first end with a ring extending therefrom and a spaced opposite externally threaded second end threadedly coupled in the bore of said base plate, a speed punching bag being releasably coupleable to the ring of said eye member.

2. An exercise structure as claimed in claim 1, wherein said mounting means further comprises an additional plate for mounting a heavy punching bag, said additional plate being slidably mounted on and supported by said base plate.

* * * * *